US009153402B2

(12) United States Patent
Ukon et al.

(10) Patent No.: US 9,153,402 B2
(45) Date of Patent: Oct. 6, 2015

(54) CUTTER

(75) Inventors: Tetsuya Ukon, Osaka (JP); Teruaki Tsuchiya, Osaka (JP); Futoshi Okugawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 294 days.

(21) Appl. No.: 13/993,947

(22) PCT Filed: Nov. 28, 2011

(86) PCT No.: PCT/JP2011/006612

§ 371 (c)(1),
(2), (4) Date: Jun. 13, 2013

(87) PCT Pub. No.: WO2012/090387

PCT Pub. Date: Jul. 5, 2012

(65) Prior Publication Data

US 2013/0255463 A1 Oct. 3, 2013

(30) Foreign Application Priority Data

Dec. 27, 2010 (JP) ..... 2010-290540

(51) Int. Cl.

| | |
|---|---|
| ***H01H 39/00*** | (2006.01) |
| ***H01H 37/76*** | (2006.01) |
| *H01H 50/54* | (2006.01) |
| *H01H 71/02* | (2006.01) |
| *H01H 89/00* | (2006.01) |

(52) U.S. Cl.

CPC ..... *H01H 39/006* (2013.01); *H01H 50/546* (2013.01); *H01H 71/02* (2013.01); *H01H 89/00* (2013.01); *Y10T 83/8858* (2015.04)

(58) Field of Classification Search

CPC ..... H01H 39/006; H01H 89/00; H01H 71/02; H01H 50/546; Y10T 83/8858

USPC ..... 337/30, 157, 401, 405; 361/115; 200/61.08

See application file for complete search history.

(56) References Cited

U.S. PATENT DOCUMENTS

| | | | | |
|---|---|---|---|---|
| 3,277,255 | A * | 10/1966 | Mattsson et al. | 200/61.08 |
| 3,660,794 | A * | 5/1972 | Brizzolara | 337/401 |
| 3,873,786 | A * | 3/1975 | Lagofun | 200/61.08 |
| 3,915,236 | A * | 10/1975 | Stichling | 169/61 |
| 3,932,717 | A * | 1/1976 | Dike et al. | 200/61.08 |
| 4,224,487 | A * | 9/1980 | Simonsen | 200/61.08 |
| 4,311,890 | A * | 1/1982 | Schroder | 200/61.08 |
| 4,417,519 | A * | 11/1983 | Lutz | 102/263 |
| 5,070,787 | A * | 12/1991 | Weldon et al. | 102/216 |
| 5,535,842 | A * | 7/1996 | Richter et al. | 180/279 |
| 5,877,563 | A * | 3/1999 | Krappel et al. | 307/10.1 |
| 6,194,988 | B1 * | 2/2001 | Yamaguchi et al. | 337/157 |
| 6,222,439 | B1 * | 4/2001 | Tanigawa et al. | 337/401 |
| 6,232,568 | B1 * | 5/2001 | Hasegawa et al. | 200/61.08 |
| 6,295,930 | B1 * | 10/2001 | Kume et al. | 102/202.5 |

(Continued)

FOREIGN PATENT DOCUMENTS

| | | |
|---|---|---|
| JP | 2002-512422 A | 4/2002 |
| JP | 2004-241389 A | 8/2004 |
| JP | 2010-866653 A | 4/2010 |

*Primary Examiner* — Anatoly Vortman

(74) *Attorney, Agent, or Firm* — Birch, Stewart, Kolasch & Birch, LLP

(57) ABSTRACT

A cutter includes a stopper with which a blade after cutting a harness with a cutting portion collides and stops. The blade includes a flexible guide portion which protrudes further in a forward direction of the blade than the cutting portion.

4 Claims, 11 Drawing Sheets

(56) References Cited

U.S. PATENT DOCUMENTS

| | | | | |
|---|---|---|---|---|
| 6,483,420 | B1 * | 11/2002 | Takahashi et al. | 337/401 |
| 6,556,119 | B1 * | 4/2003 | Lell | 337/157 |
| 6,843,157 | B2 * | 1/2005 | Hamilton et al. | 83/639.4 |
| 7,123,124 | B2 * | 10/2006 | Caruso et al. | 337/157 |
| 7,205,879 | B2 * | 4/2007 | Kordel et al. | 337/401 |
| 7,222,561 | B2 * | 5/2007 | Brede et al. | 83/639.4 |
| 7,239,225 | B2 * | 7/2007 | Tirmizi | 337/30 |
| 7,772,958 | B2 * | 8/2010 | Schlotzer | 337/157 |
| 8,432,246 | B2 * | 4/2013 | Suzuki et al. | 337/157 |
| 2004/0041682 | A1 * | 3/2004 | Pasha et al. | 337/401 |
| 2004/0221638 | A1 | 11/2004 | Brede et al. | |
| 2010/0218659 | A1 * | 9/2010 | Ukon et al. | 83/639.1 |

* cited by examiner

CUTTER

TECHNICAL FIELD

The present invention relates to cutters configured to cut current-carrying members through which current flows.

BACKGROUND ART

Cutters configured to cut current-carrying members through which current flows have been known. Cutters of this type are used to shut off power from a power supply, for example, in disaster situations. Patent Document 1 shows a cutter which includes a blade having an approximately columnar cutting portion, and which is configured such that the blade propelled by an explosion of an explosive that fills a gas generation chamber in a cylindrical case moves forward to cut a target current-carrying member with the cutting portion. After the blade propelled by the explosion cuts the current-carrying member, the blade collides with a blade stopper and stops.

CITATION LIST

Patent Document

Patent Document 1: Japanese Patent Publication No. 2010-86653

SUMMARY OF THE INVENTION

Technical Problem

However, in the cutter shown in Patent Document 1, a great propelling force is caused by the explosion of the explosive, and therefore, the cutting portion may hit the blade stopper when the blade collides with the blade stopper, and the blade may bounce back as a result. Thus, the cut surfaces of the current-carrying member may be electrically connected together via the cut portion, and the insulation capability of the cutter may be reduced.

The present invention is thus intended to prevent a blade from bouncing back after cutting a current-carrying member.

Solution to the Problem

The first aspect of the present invention is directed to a cutter, including a blade (30) which has a cutting portion (31), and a case member (11) which accommodates the blade (30) such that the blade (30) is movable in a forward and backward direction, the cutter being configured such that the blade (30) is moved in a predetermined forward direction by increasing a pressure in the case member (11) by a high-pressure gas generated by a reaction of a gas-generating agent, thereby cutting, with the cutting portion (31), a current-carrying member (12) which is located forward of the blade (30) and through which electricity flows, wherein the cutter includes a stopper member (23) with which the blade (30) after cutting the current-carrying member (12) with the cutting portion (31) collides and stops, and the blade (30) includes a flexible guide member (32*a*) which is provided at the blade (30) and protrudes further in the forward direction of the blade (30) than the cutting portion (31).

According to the first aspect of the present invention, the cutter is provided with a stopper member (23) with which the blade (30) after cutting a target collides and stops. Further, the blade (30) includes a flexible guide member (32*a*).

When a high-pressure gas is generated by a reaction of the gas-generating agent, the blade (30) moves in a predetermined forward direction in the case member (11). When the blade (30) moves forward, the cutting portion (31) cuts the current-carrying member (12), and when the blade (30) moves further forward, the guide member (32*a*) collides with the stopper member (23) earlier than the cutting portion (31). The guide member (32*a*) absorbs the impact force of the collision and is deformed. As a result, the blade (30) having collided with the stopper member (23) is stopped without bouncing back in a direction opposite to the forward direction. Also, since the guide member (32*a*) absorbs the impact, the stopper member (23) with which the guide member (32*a*) collides is not damaged.

The second aspect of the present invention is that in the first aspect of the present invention, the blade (30) is positioned such that before the blade (30) is moved forward, a front end of the guide member (32*a*) is located forward of a back end of the current-carrying member (12) in the forward direction of the blade (30).

According to the second aspect of the present invention, the front end of the guide member (32*a*) of the blade (30) that has not moved forward yet is located forward of the back end of the current-carrying member (12) in the forward direction of the blade (30). It is thus possible to prevent rotation of the blade (30). With the guide member (32*a*), it is possible to fix the positional relationship between the blade (30) and the cutting portion (31), and the current-carrying member (12).

When the high-pressure gas is generated by the reaction of the gas-generating agent, the blade (30) moves in a predetermined forward direction in the case member (11). At this moment, the guide member (32*a*) moves along sides of the current-carrying member (12) and leads the cutting portion (31) to the current-carrying member (12). When the blade (30) moves forward, the cutting portion (31) reaches the current-carrying member (12) and cuts the current-carrying member (12). When the blade (30) moves further forward, the guide member (32*a*) absorbs the impact force of the collision and is deformed. As a result, the blade (30) having collided with the stopper member (23) is stopped without bouncing back in a direction opposite to the forward direction. Since the guide member (32*a*) absorbs the impact, the stopper member (23) with which the guide member (32*a*) collides is not damaged.

The third aspect of the present invention is that in the first or second aspect of the present invention, the cutting portion (31) has an edge portion (31*a*) made of a resin material.

According to the third aspect of the present invention, the blade (30) moves in a predetermined forward direction, and the edge portion (31*a*) cuts the current-carrying member (12). If the edge portion (31*a*) is made of a metal, the cut surfaces may be electrically connected via the edge portion (31*a*), and the insulating properties may be reduced. By contrast, since the edge portion (31*a*) is made of a resin material, the insulating properties are not reduced even if the edge portion (31*a*) is present between the cut surfaces.

The fourth aspect of the present invention is that in any one of the first to third aspects of the present invention, the case member (11) includes a first case member (27) having a back pressure chamber (36) in which the high-pressure gas is generated by the reaction of the gas-generating agent, and a second case member (20) configured to accommodate the blade (30) and provided with a placement hole (22) located forward of the cutting portion (31) of the blade (30) that is not moved forward yet, for inserting the current-carrying member (12) to be cut.

According to the fourth aspect of the present invention, the second case member (20) accommodates the blade (30) inside, and is provided with a placement hole (22) located forward of the cutting portion (31) of the blade (30) that is not moved forward yet. The current-carrying member (12) to be cut is inserted in the placement hole (22). The first case member (27) has a back pressure chamber (36) in which the high-pressure gas is generated by the reaction of the gas-generating agent.

When the high-pressure gas is generated in the back pressure chamber (36) by the reaction of the gas-generating agent, the blade (30) moves forward (i.e., travels) due to the pressure of the high-pressure gas, and the cutting portion (31) cuts the current-carrying member (12) inserted in the placement hole (22).

Advantages of the Invention

According to the first aspect of the present invention, the blade (30) includes a flexible guide member (32*a*). Thus, it is possible to make the guide member (32*a*) collide with the stopper member (23) and stop the forward movement of the blade (30). When the guide member (32*a*) collides with the stopper member (23), the guide member (32*a*) absorbs the impact and is deformed. As a result, it is possible to reliably prevent the blade (30) from bouncing back due to the impact force of the collision. Further, since the guide member (32*a*) absorbs the impact, it is possible to reliably prevent the stopper member (23) with which the guide member (32*a*) collides from being damaged.

According to the second aspect of the present invention, the guide member (32*a*) is located forward of the current-carrying member (12) in the forward direction of the blade (30). Thus, it is possible to reliably prevent the rotation of the blade (30). As a result, the positional relationship between the current-carrying member (12) and the blade (30) and the cutting portion (31) can be fixed. It is thus possible to cut the current-carrying member (12) with reliability.

Further, since positioning between the blade (30) and the cutting portion (31), and the current-carrying member (12) is not necessary in assembling the cutter, such a positioning step can be omitted. In addition, the structure of the cutter can be simplified because it is possible to fix the positional relationship between the current-carrying member (12), and the blade (30) and the cutting portion (31) without providing a separate means configured to fix the blade (30). As a result, costs for the cutter can be reduced.

According to the third aspect of the present invention, the edge portion (31*a*) is made of a resin material. Thus, the material cost can be smaller than in the case where the edge portion (31*a*) is made of a metal material. Further, it is possible reliably prevent the cut surfaces of the narrow portion (12*a*) from being electrically connected together via the edge portion (31*a*). Thus, insulation capability of the cut surfaces of the current-carrying member (12) can be ensured.

According to the fourth aspect of the present invention, the case member (11) is comprised of the first case member (27) and the second case member (20). Thus, the first case member (27) and the second case member (20) can be formed of different materials. That is, for example, the first case member (27) having the back pressure chamber (36) in which the high-pressure gas is generated may be made of a metal material, and the second case member (20) may be made of a resin material. As a result, costs for the case member (11) can be reduced.

DESCRIPTION OF EMBODIMENTS

Embodiments of the present invention will be described in detail below with reference to the drawings.

First Embodiment of the Invention

As shown in FIG. 1 to FIG. 5, a cutter (10) according to the first embodiment is configured to cut a harness (12), which comprises a current-carrying member of the present invention, by moving a blade (30) forward using high-pressure gas generated by a reaction of a gas-generating agent. The cutter (10) uses an explosive as the gas-generating agent for generating high-pressure gas.

Figure 1:
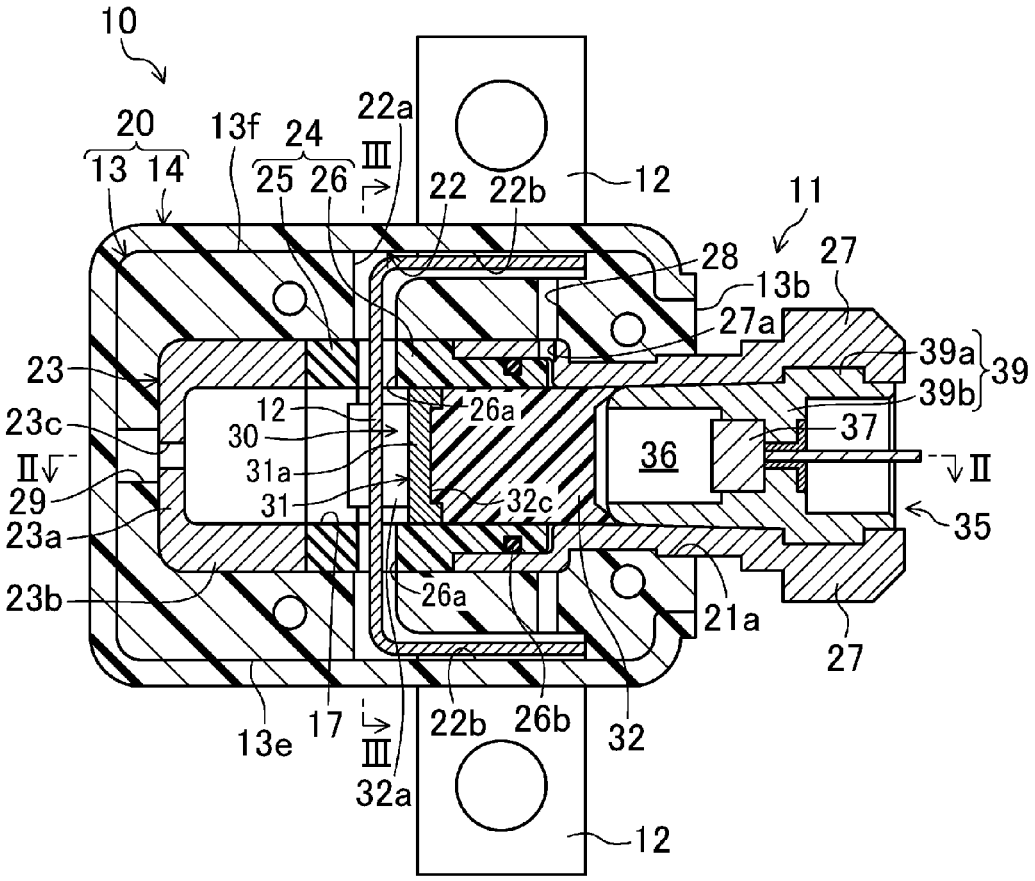
FIG. 1 is a vertical cross-sectional view showing a cutter of the first embodiment.
Figure 5:
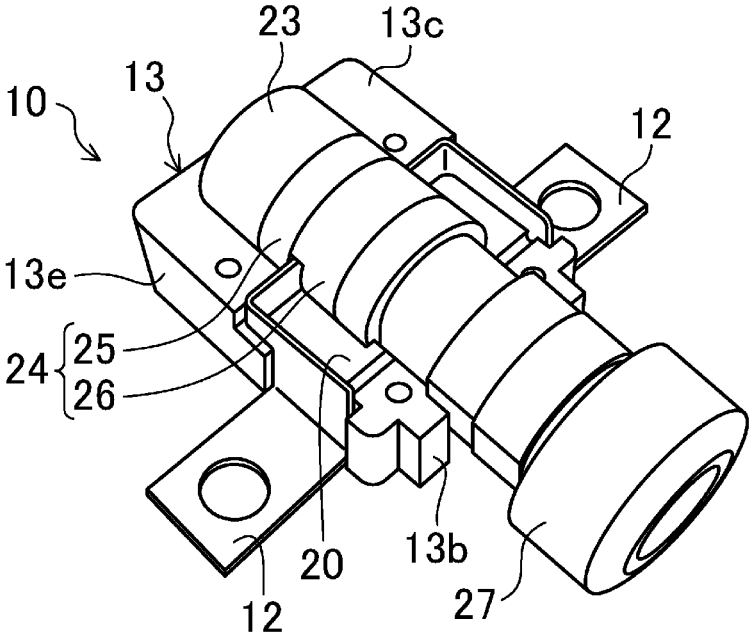
FIG. 5 is an oblique view of an internal structure of the cutter of the first embodiment.

Specifically, the cutter (10) includes a case (11) as illustrated in FIG. 1 and FIG. 5, and a stopper (23), an inner cylinder (24), a blade (30), and a gas generator (35) are accommodated in the case (11). The case (11) comprises a case member of the present invention.

Figure 2:
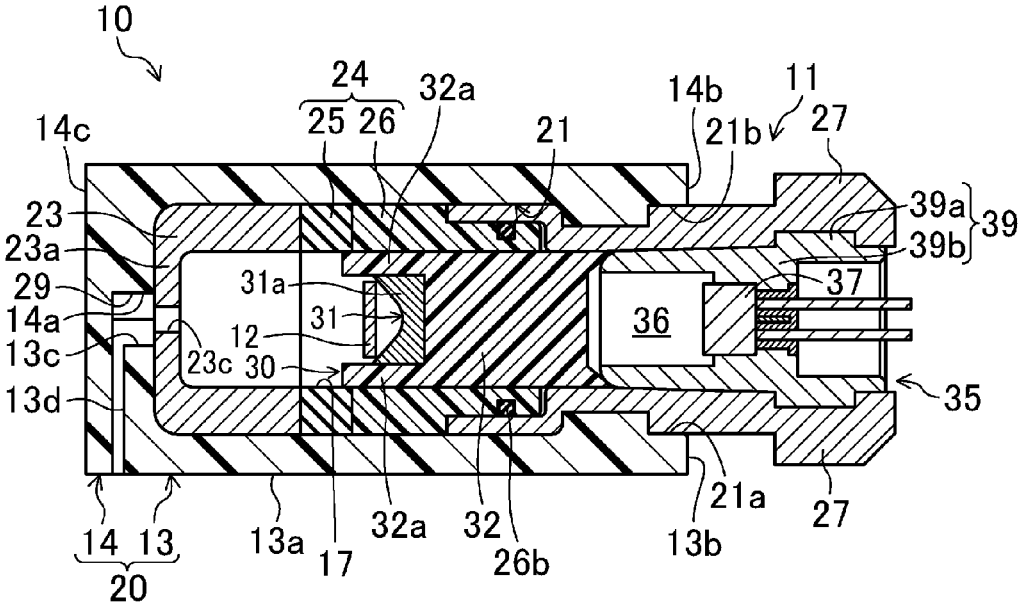
FIG. 2 is a cross-sectional view taken along the line of FIG. 1.

For convenience of explanation, the left-hand side of FIG. 2 is hereinafter referred to as the "front side," the right-hand side of FIG. 2 is hereinafter referred to as the "back side," the upper side of FIG. 2 is hereinafter referred to as the "upper side," and the lower side of FIG. 2 is hereinafter referred to as the "lower side." The front side of the drawing sheet of FIG. 2 in the direction orthogonal to the drawing sheet is hereinafter referred to as the "left side," and the back side thereof is hereinafter referred to as the "right side."

As illustrated in FIG. 1, FIG. 2, FIG. 4, and FIG. 5, the case (11) includes a box-shaped resin case (20) and a cylindrical metal case (27). A front portion of the metal case (27) is accommodated in a below-described insertion hole (21) in the resin case (20).

The resin case (20) is made of a resin, such as polycarbonate (PC). The resin case (20) comprises a second case member of the present invention. The resin material which forms the resin case (20) is not limited to the PC resin, and may be a resin material, such as plastic. The resin case (20) includes an approximately rectangular parallelepiped base (13) and a cover (14) which continuously covers surfaces of the base (13) except a lower surface (13*a*) and a back surface (13*b*) of the base (13).

A groove (21*a*) having a semicircular cross-section is formed in an upper surface (13*c*) of the base (13). The groove (21*a*) extends from the back surface (13*b*) of the base (13) toward a front surface (13*d*) thereof, and is open only on the back surface (13*b*).

The cover (14) covers the upper surface (13*c*), the front surface (13*d*), a left surface (13*e*) and a right surface (13*f*) of the base (13). A groove (21*b*) which corresponds to the groove (21*a*) in the base (13) is formed in an opposed surface (14*a*) of the cover (14) which faces the upper surface (13*c*) of the base (13). The groove (21*b*) extends from the back surface (14*b*) of the cover (14) toward the front surface (14*c*) thereof, and is open only on the back surface (14*b*).

With this configuration, an approximately cylindrical insertion hole (21) which is open on the back end surface of the resin case (20) is formed in the resin case (20) by the groove (21*a*) of the base (13) and the groove (21*b*) of the cover (14). The insertion hole (21) accommodates the stopper (23), the inner cylinder (24), and the front portion of the metal case (27) in sequential order from the front end toward the back end of the insertion hole (21).

Further, the resin case (20) has a placement hole (22) which is astride the base (13) and the cover (14), and is configured to place the harness (12) therein. The placement hole (22) is symmetric with respect to a vertical plane including the axis of the insertion hole (21). Specifically, the placement hole (22) extends laterally outward from a longitudinally central portion of the insertion hole (21), is subsequently bent backward, and is then bent downward, and extends to the lower surface (13*a*) of the base (13). Part of the placement hole (22) from a portion extending laterally outward from the insertion hole (21) to a portion bent backward is a narrow portion (22*a*), and part of the placement hole (22) which extends downward thereafter is a wide portion (22*b*) whose width is larger than the width of the narrow portion (22*a*).

Figure 3:
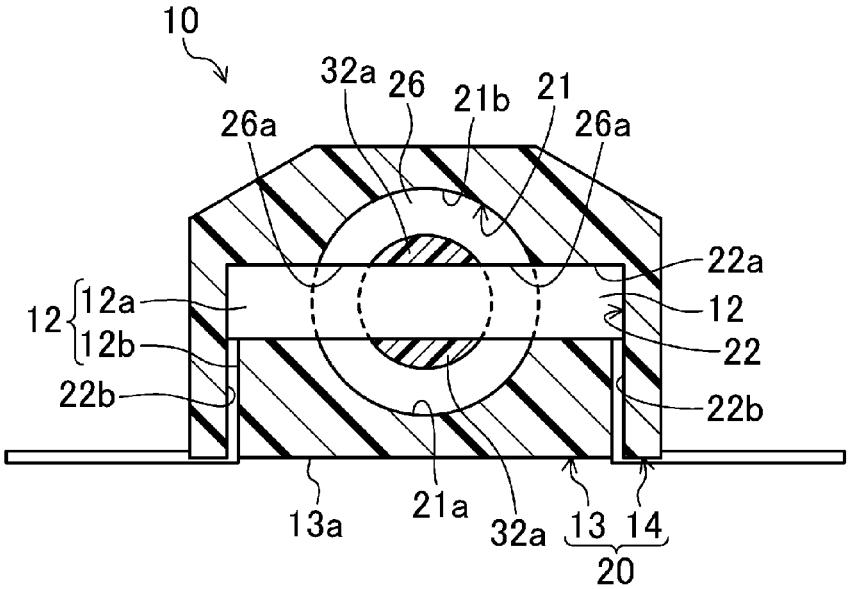
FIG. 3 a cross-sectional view taken along the line of FIG. 1.
Figure 4:
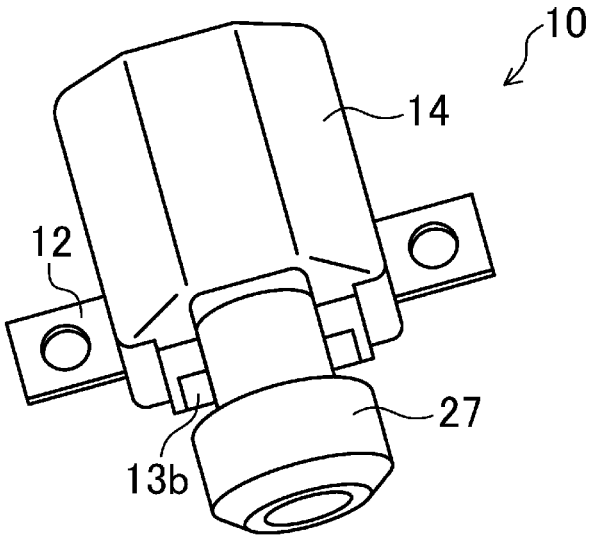
FIG. 4 is an oblique view of an external structure of the cutter of the first embodiment.
Figure 6:
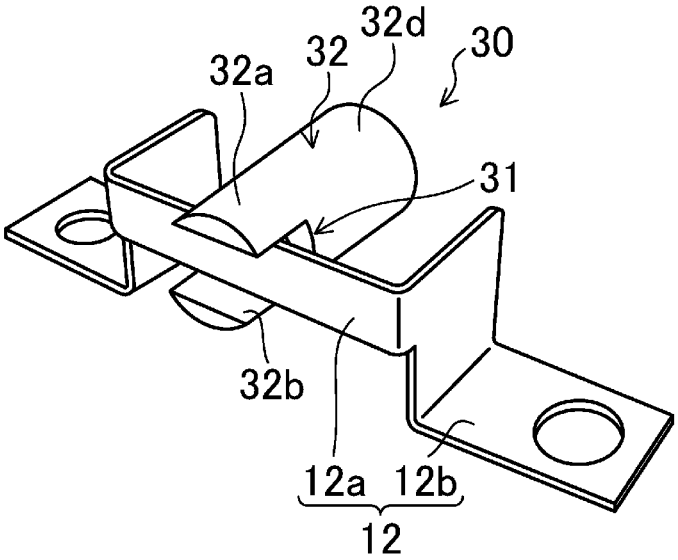
FIG. 6 shows oblique views of a blade and a harness of the first embodiment.

The harness (12) to be placed in the placement hole (22) is in a long plate shape, and has a narrow portion (12*a*) bent into an approximately U-shape and two wide portions (12*b*) continuously provided on both ends of the narrow portion (12*a*) as illustrated in FIG. 3 and FIG. 6. Each of the two wide portions (12*b*) is a plate-like piece in an approximately L-shape. Part of the harness (12) is placed in the placement hole (22) of the resin case (20) such that the narrow portion (12*a*) is located in the narrow portion (22*a*) of the placement hole (22), and such that part of the narrow portion (12*a*) is located in the wide portion (22*b*) of the placement hole (22). The narrow portion (12*a*) comprises a portion at which the harness (12) is cut.

The resin case (20) further includes an exhaust passage (28) which connects the insertion hole (21) and the placement hole (22) and which is astride the base (13) and the cover (14). The exhaust passage (28) comprises part of an exhaust gas passage configured to exhaust high-pressure gas generated by a below-described gas generator (35) to move the blade (30) forward. The exhaust passage (28) is formed such that one end thereof communicates with the insertion hole (21) on the back side of the narrow portion (22*a*) of the placement hole (22), and such that the other end communicates with the wide portion (22*b*) of the placement hole (22).

The resin case (20) further includes an exhaust hole (29) configured to exhaust air from the front end of the insertion hole (21). The exhaust hole (29) extends forward from a central portion of the front end of the insertion hole (21), and is then bent downward to the lower surface (13*a*) of the base (13).

The stopper (23) is configured to receive and stop the blade (30) moving forward. The stopper (23) is made of a resin material formed in the shape of a bottomed cylinder, and located at a front end portion of the insertion hole (21). Specifically, the stopper (23) has a disk-like bottom portion (23*a*) and a cylindrical cylinder portion (23*b*), and is disposed such that the bottom portion (23*a*) is located forward of the cylinder portion (23*b*) at the front end portion of the insertion hole (21). A hole (23*c*) is formed in a central portion of the bottom portion (23*a*) to communicate with the exhaust hole (29) of the resin case (20). Further, the cylinder portion (23*b*) is configured to have an inner diameter through which the blade (30) can travel.

The inner cylinder (24) is disposed behind the stopper (23) in the insertion hole (21) to support the harness (12). The inner cylinder (24) includes a first inner cylinder member (25) and a second inner cylinder member (26), and the harness (12) is sandwiched between the members (25, 26).

The first inner cylinder member (25) is made of ceramic formed in an approximately cylindrical shape, and is disposed behind the stopper (23) in the insertion hole (21) so as to be coaxial with the stopper (23). The first inner cylinder member (25) is configured such that the inner diameter thereof is approximately equal to the inner diameter of the cylinder portion (23*b*) of the stopper (23), and the outer diameter thereof is approximately equal to the inner diameter of the insertion hole (21).

The second inner cylinder member (26) is made of a resin material in an approximately cylindrical shape, and is disposed behind the first inner cylinder member (25) in the insertion hole (21) so as to be coaxial with the first inner cylinder member (25). The second inner cylinder member (26) is configured such that the inner diameter thereof is approximately equal to the inner diameter of the first inner cylinder member (25). Further, the outer diameter of a front portion of the second inner cylinder member (26) is approximately equal to the inner diameter of the insertion hole (21), and the second inner cylinder member (26) has a smaller outer diameter at a back portion thereof than the front portion. Two cutouts (26*a*) through which the harness (12) is inserted are formed in the front portion of the second inner cylinder member (26). The two cutouts (26*a*) are located to correspond to the placement hole (22) of the resin case (20). Each of the cutouts (26*a*) extends from the outer circumferential surface of the second inner cylinder member (26) toward the inner circumferential surface of the second inner cylinder member (26), and has a rectangular cross section which is slightly larger than the rectangular cross section of the harness (12). An annular groove is formed in the outer circumferential surface of the back portion of the second inner cylinder member (26), and an O ring (26*b*) is placed in the groove.

As described, the inner cylinder (24) is configured to support the harness (12) by sandwiching, from both sides, the harness (12) between the first inner cylinder member (25) and the second inner cylinder member (26) which are insulating members.

The metal case (27) is made of a metal material formed in an approximately cylindrical shape. A front portion of the metal case (27) is housed in the insertion hole (21), and a back portion of the metal case (27) is exposed from the resin case (20). The front portion of the metal case (27) is disposed behind the second inner cylinder member (26) in the insertion hole (21), and is coaxial with the second inner cylinder member (26). A front end portion of the metal case (27) is fitted to the outer surface of the back portion of the second inner cylinder member (26). The gap between the back portion of the second inner cylinder member (26) and the front end portion of the metal case (27), which is fitted to the outer surface of the back portion of the second inner cylinder member (26), is sealed with the O ring (26*b*). A through hole (27*a*) is formed in the front end portion of the metal case (27). The through hole (27*a*) is formed at a location corresponding to the exhaust passage (28) of the resin case (20). The inner diameter of the front portion of the metal case (27), except the inner diameter of the front end portion, is approximately equal to the inner diameter of the second inner cylinder member (26), and the outer diameter of the front portion of the metal case (27) is approximately equal to the inner diameter of the insertion hole (21). Further, the metal case (27) comprises a first case member of the present invention.

The stopper (23), the inner cylinder (24), and the metal case (27) which are housed in the insertion hole (21) form an approximately cylindrical passage (17) therein. The cylindrical passage (17) has a front end portion blocked by the bottom portion (23*a*) of the stopper (23), and a back end portion blocked by the gas generator (35) housed in the metal case (27). Part of the narrow portion (12*a*) of the harness (12) housed in the placement hole (22) is exposed in the cylindrical passage (17), and the blade (30) is housed in a space between the exposed part and the gas generator (35).

The gas generator (35) is configured to generate high-pressure gas for letting the blade (30) move forward to cut the harness (12). The gas generator (35) includes an explosive as a gas-generating agent, an igniter (37) configured to initiate the explosive, and a lid member (39) configured to hold the igniter (37) and block the back end portion of the cylindrical passage (17).

The lid member (39) includes a cylinder portion (39*a*) formed in an approximately cylindrical shape and fitted to an inner surface of the metal case (27), and a blocking portion (39*b*) which holds the igniter (37) and blocks a middle portion of the cylinder portion (39*a*). The cylinder portion (39*a*) and the blocking portion (39*b*) are integrally formed using a metal material. A closed space is formed behind the blade (30) in the cylindrical passage (17) by the blocking portion (39*b*). The closed space forms a gas generation chamber (36) filled with the explosive.

The igniter (37) is a detonator, and is held by the blocking portion (39*b*) of the lid member (39) such that a front end portion of the igniter (37) at which a primary explosive is contained is exposed in the gas generation chamber (36).

With this configuration, when the igniter (37) allows the explosive in the gas generation chamber (36) to explode, high-pressure gas is generated in the gas generation chamber (36), and the high-pressure gas increases the pressure in the gas generation chamber (36), thereby moving the blade (30) forward. The gas generation chamber (36) comprises a back pressure chamber of the present invention.

Figure 7:
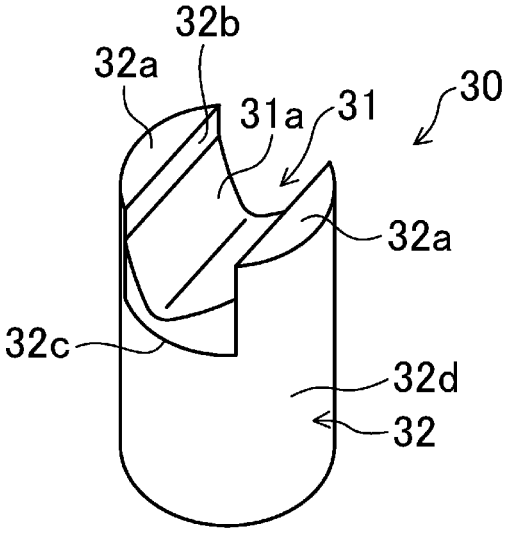
FIG. 7 is an oblique view of the blade of the first embodiment.

The blade (30) is configured to move forward in the cylindrical passage (17) formed in the insertion hole (21) due to the high-pressure gas, and cut the harness (12). As illustrated in FIG. 6 and FIG. 7, the blade (30) includes a cutting portion (31) and a pusher (32) to which the cutting portion (31) is secured.

The pusher (32) is configured to move the blade (30) forward due to the pressure of the high-pressure gas of the igniter (37). The pusher (32) includes a body (32*d*) and a front end portion (32*c*).

The body (32*d*) is made of resin in an approximately columnar shape. The gas generation chamber (36) is disposed behind the body (32*d*).

The front end portion (32*c*) forms a front surface of the pusher (32). The front end portion (32*c*) is in an approximately U-shape, and is integrally formed with the body (32*d*) at a front end of the body (32*d*). The cutting portion (31) is attached to the base end of the front end portion (32*c*), and a projecting portion extending forward forms a pair of guide portions (32*a*, 32*a*).

The pair of guide portions (32*a*, 32*a*) are configured to guide the blade (30) mentioned later, and comprises guide members of the present invention. Each of the guide portions (32*a*) is a projection made of a resin material and extending forward from the pusher (32), and the projection includes an outer peripheral surface in an arc shape approximately concentric with the body (32*d*) and a flat inner peripheral surface. The guide portions (32*a*) only need to be made of a flexible material. The guide portions (32*a*) may be made of, e.g., a resin material or plastic. The configuration of the guide portions (32*a*) of the front end portion (32*c*) is merely an example, and is not limited to this configuration. For example, the front end portion (32*c*) may be configured to include a projecting portion at only one side of the front end portion (32*c*), and this projecting portion may comprise the guide portion (32*a*). Even if the guide portion (32*a*) is provided only at one side of the front end portion (32*c*), similar effects and advantages as obtained in the configuration where the projecting portions are provided at both sides of the front end portion (32*c*) can be obtained.

The pusher (32) which has not yet moved forward is positioned such that the front ends of the guide portions (32*a*) project forward of the harness (12). The pair of guide portions (32*a*, 32*a*) are positioned such that the inner surfaces (32*b*, 32*b*) thereof face each other, and the narrow portion (12*a*) of the harness (12) is placed between the pair of guide portions (32*a*, 32*a*). That is, the blade (30) which has not yet moved forward is held such that the harness (12) is sandwiched between the pair of guide portions (32*a*, 32*a*). It is therefore possible to prevent rotation of the blade (30). In addition, the positional relationship between an edge portion (31*a*) and the harness (12) at the time of cutting is fixed. That is, the edge portion (31*a*) of the blade (30) which has not yet moved forward is positioned to face the narrow portion (12*a*) of the harness (12). The inner surfaces (32*b*) of the guide portions (32) and the respective side surfaces of the narrow portion (12*a*) of the harness (12) may be in contact with each other.

The cutting portion (31) is configured to cut the harness (12). The cutting portion (31) has an edge portion (31*a*) made of a metal material (e.g., steel) at the front end of the cutting portion (31). The cutting edge of the edge portion (31*a*) is in an approximately V-shape opening toward the front end. The side surface of the edge portion (31*a*) is in contact with the inner surfaces (32*b*) of the guide portions (32*a*). That is, the edge portion (31*a*) is attached to a base end portion of the front end portion (32*c*) of the pusher (32) by being fitted into a space between the inner surfaces (32*b*, 32*b*) of the pair of guide portions (32*a*, 32*a*).

—Operation—

The cutter (10) of the first embodiment is provided such that a harness (12) of an electrical device in a factory, for example, is inserted in the placement hole (22) to pass through the space between the first inner cylinder member (25) and the second inner cylinder member (26).

The cutter (10) is provided, with the igniter (37) being connected to a fire alarm or an earthquake alarm, etc. When the fire alarm detects fire, or the earthquake alarm detects an earthquake, an alarm signal is fed to the igniter (37). When the alarm signal is fed to the igniter (37), the igniter (37) explodes the explosive in the gas generation chamber (36).

Figure 8:
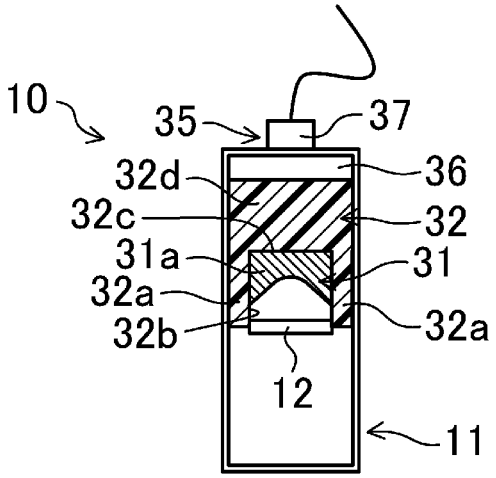
FIG. 8 is a schematic view of the cutter of the first embodiment.

As illustrated in FIG. 8, when the explosive goes off, high-pressure gas is generated in the gas generation chamber (36) by the explosion, which provides a thrust to the pusher (32) to cause the blade (30) to move forward. Since the inner surfaces (32*b*, 32*b*) of the pair of guide portions (32*a*, 32*a*) are located on sides of the narrow portion (12*a*) of the harness (12) to sandwich the narrow portion (12*a*), the cutting portion (31) is guided along the guide portions (32*a*, 32*a*) with the forward movement of the pusher (32). When the blade (30) moves forward, the front end of the edge portion (31*a*) reaches the narrow portion (12*a*) of the harness (12) and cuts the narrow portion (12*a*) instantly. When the blade (30) moves further forward, the guide portions (32*a*) collides with the bottom portion (23*a*) of the stopper (23). The guide portions (32*a*) are deformed by the impact of the collision. The blade (30) stops without bouncing back in the stopper (23) because the guide portions (32*a*) absorb the impact of the collision. In this state, the body (32*d*) of the pusher (32) is in contact with the points at which the harness (12) has been cut. Therefore, no electricity flows through the harness (12).

When the pusher (32) moves forward, the gas generation chamber (36) communicates with the through hole (27*a*) and the exhaust passage (28). When the gas generation chamber (36) communicates with the through hole (27*a*) and the exhaust passage (28), the high-pressure gas in the gas generation chamber (36) is exhausted to the outside through the through hole (27*a*) and the exhaust passage (28).

Advantages of the First Embodiment

In the first embodiment, since the blade (30) includes the flexible guide portions (32*a*), it is possible to stop the forward-moving blade (30) by making the guide portions (32*a*) collide with the stopper (23). When the guide portions (32*a*) collide with the stopper (23), the guide portions (32*a*) absorb the impact and are deformed. It is thus possible to reliably prevent the blade (30) from bouncing back due to the impact force of the collision. Further, since the guide portions (32*a*) absorb the impact, it is possible to reliably prevent the stopper (23) with which the guide portions (32*a*) collide from being damaged or broken.

Further, since the front ends of the guide portions (32*a*) are located forward of the harness (12), it is possible to reliably prevent rotation of the blade (30) in the circumferential direction thereof. Thus, the positional relationship between the harness (12), and the blade (30) and the cutting portion (31) can be fixed. As a result, the harness (12) can be cut with reliability. Further, since positioning between the blade (30) and the cutting portion (31), and the harness (12) is not necessary in assembling the cutter (10), such a positioning step can be omitted. In addition, the structure of the cutter (10) can be simplified because it is possible to fix the positional relationship between the harness (12), and the blade (30) and the cutting portion (31) without providing a separate means configured to fix the blade (30). As a result, costs for the cutter (10) can be reduced.

Further, the case (11) is comprised of the metal case (27) and the resin case (20). Thus, the metal case (27) and the resin case (20) can be formed of different materials. Since the resin case (20) is provided, the material cost can be reduced compared to the case in which the whole case (11) is made of a metal material. Moreover, since the metal case (27) is provided, only a portion of the case (11) to which the pressure of the high-pressure gas generated in the gas generator (35) is applied may be made of a metal. Thus, it is possible to ensure sufficient strength of the case (11) as a whole.

Lastly, by providing the resin case (20) having the placement hole (22), it is possible to separate the harness (12) from the metal case (27), and thus avoid the risk of a discharge between the harness (12) and the metal case (27).

First Variation of First Embodiment

Figure 9:
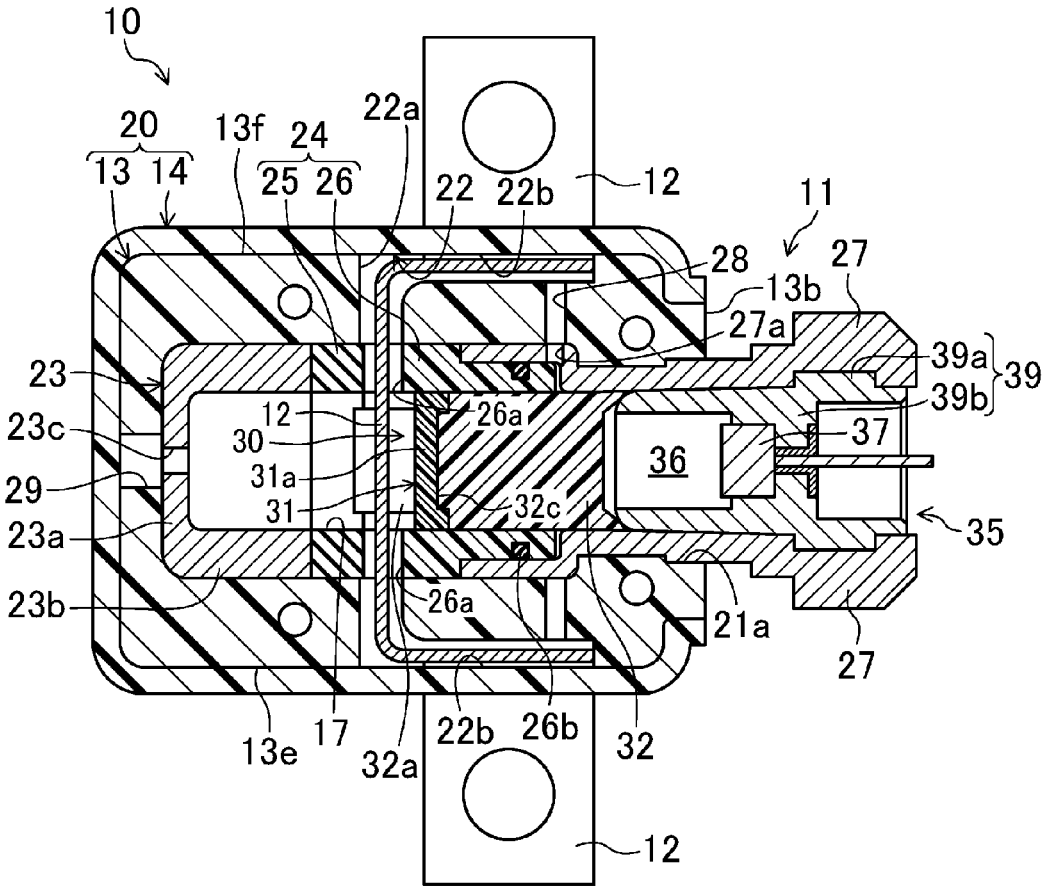
FIG. 9 is a vertical cross-sectional view of a cutter of the first variation of the first embodiment.

Now, the first variation of the first embodiment will be described. As shown in FIG. 9, a cutter (10) of the first variation has a cutting portion (31) whose configuration is different from the configuration of the cutting portion (31) of the cutter (10) of the first embodiment.

Specifically, in the cutter (10) of the first variation, the edge portion (31*a*) of the cutting portion (31) is made of a resin material. The resin material used in this first variation includes plastic, etc. In this cutter (10), when an explosive goes off, high-pressure gas is generated in the gas generation chamber (36) by the explosion, which provides a thrust to the pusher (32) to cause the blade (30) to move forward. The inner surfaces (32*b*, 32*b*) of the pair of guide portions (32*a*, 32*a*) are located on sides of the narrow portion (12*a*) of the harness (12) to sandwich the narrow portion (12*a*). Thus, the cutting portion (31) is guided along the guide portions (32*a*, 32*a*) with the forward movement of the pusher (32). When the blade (30) moves forward, the front end of the edge portion (31*a*) reaches the narrow portion (12*a*) of the harness (12) and cuts the narrow portion (12*a*) instantly. When the blade (30) moves further forward, the guide portions (32*a*) collide with the bottom portion (23*a*) of the stopper (23) and are deformed by the impact of the collision. The blade (30) stops without bouncing back in the stopper (23) because the guide portions (32*a*) absorb the impact of the collision. In this state, the body (32*d*) of the pusher (32) is in contact with the points at which the harness (12) has been cut. Therefore, no electricity flows through the harness (12).

In the first variation, the edge portion (31*a*) is made of a resin material. Thus, the material cost can be smaller than in the case where the edge portion (31*a*) is made of a metal material. Further, it is possible to reliably prevent the cut surfaces of the narrow portion (12*a*) of the harness (12) from being electrically connected together via the edge portion (31*a*). Thus, insulation capability of the cut surfaces of the harness (12) can be ensured. The other configurations, effects and advantages are the same as those in the first embodiment.

Second Variation of First Embodiment

Figure 10:
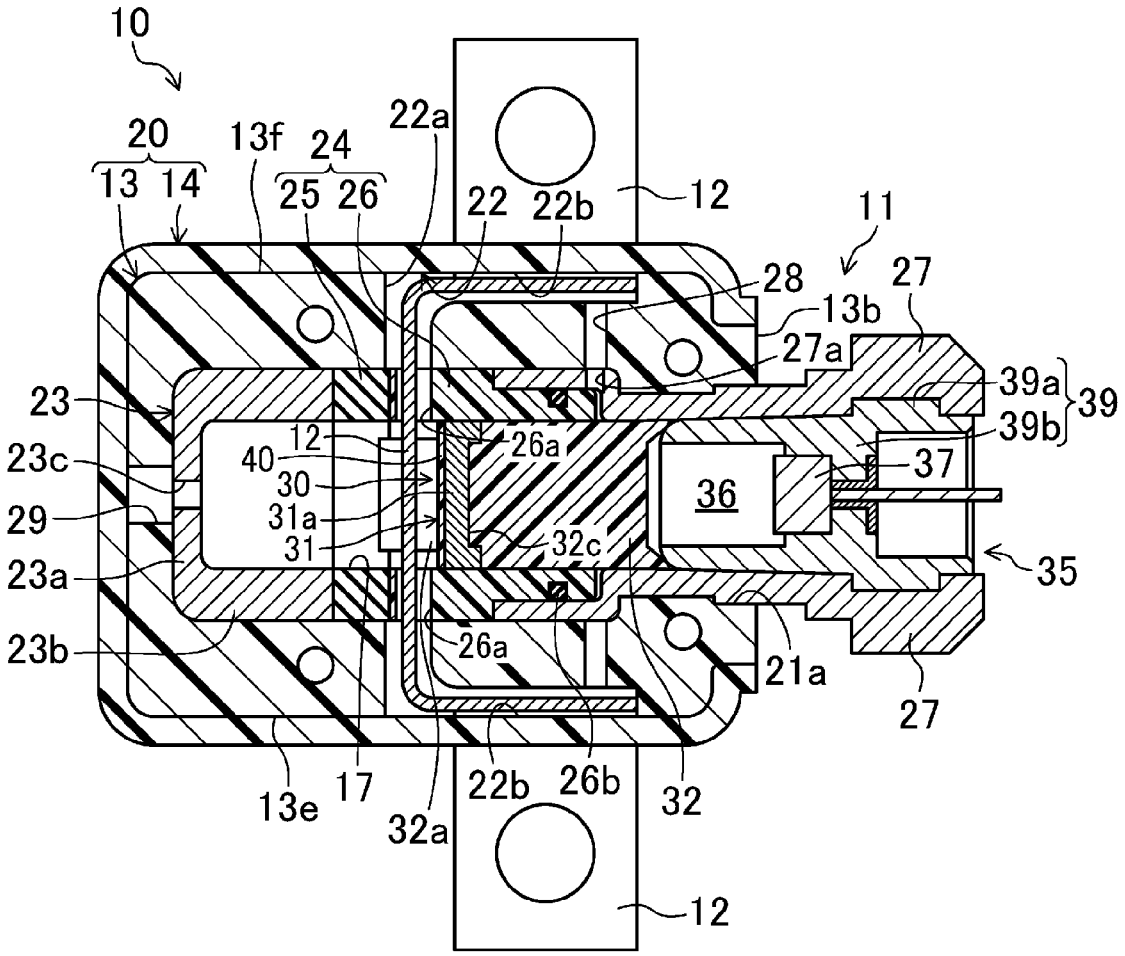
FIG. 10 is a vertical cross-sectional view of a cutter of the second variation of the first embodiment.

Now, the second variation of the first embodiment will be described. As shown in FIG. 10, a cutter (10) of the second variation has a cutting portion (31) and a first inner cylinder member (25) of which the configurations are different from the configurations of the cutting portion (31) and the first inner cylinder member (25) of the cutter (10) of the first embodiment.

Specifically, in the cutter (10) of the second variation, a coating film (40) is provided on the front end of the edge portion (31*a*) of the blade (30). Also, a coating film (40) is provided on the back end of the first inner cylinder member (25).

The coating film (40) for the blade (30) covers the entire front end of the edge portion (31*a*) of the cutting portion (31). This coating film (40) is integrally formed with the pusher (32) and the guide portions (32*a*). Thus, the fabrication cost can be reduced compared to the case in which the coating film (40), the pusher (32), and the guide portions (32*a*) are separately fabricated. The blade (30) is fabricated by fitting the cutting portion (31) to a predetermined position after the coating film (40), the pusher (32), and the guide portions (32*a*) are integrally formed.

The coating film (40) for the first inner cylinder member (25) is provided on a portion of the first inner cylinder member (25) which faces the narrow portion (12*a*) of the harness (12).

In the second variation, the coating films (40) are provided on the edge portion (31*a*) and the first inner cylinder member (25). Therefore, even if the harness (12) comes into contact with the edge portion (31*a*) or the first inner cylinder member (25) due to oscillation, etc., the harness (12) is not scraped. It is thus possible to reliably prevent a reduction in insulating properties of the cut portion due to metal powder generated from the harness (12). The other configurations, effects and advantages are the same as those in the first embodiment.

Third Variation of First Embodiment

Figure 11:
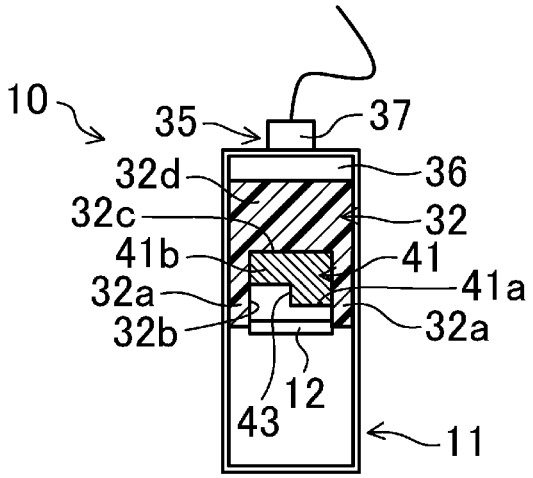
FIG. 11 is a schematic view of a cutter of the third variation of the first embodiment.

Now, the third variation of the first embodiment will be described. As shown in FIG. 11, the cutter (10) of the third variation has a cutting portion of which the configuration is different from the configuration of the cutting portion of the cutter (10) of the first embodiment.

Specifically, the cutting portion (41) of the cutter (10) of the third variation is configured to cut the harness (12) using two front and back cutting portions having different heights. Specifically, the cutting portion (41) has a first edge portion (41*a*) located toward the front (i.e., the front end), and a second edge portion (41*b*) different in height from the first edge portion (41*a*) by a height (43) and is located toward the back. The cutting portion (41) is fitted to the base end of the front end portion (32*c*) of the pusher (32) so as to be located between the pair of guide portions (32*a*, 32*a*). The front end of each of the first edge portion (41*a*) and the second edge portion (41*b*) is flat. Each of the first edge portion (41*a*) and the second edge portion (41*b*) may be made of a metal material, or may be made of a resin material.

The height (43) of the cutting portion (41) is greater than the thickness of the narrow portion (12*a*) of the harness (12). Thus, after the first edge portion (41*a*) has cut the narrow portion (12*a*) of the harness (12) at a point, the second edge portion (41*b*) can cut the narrow portion (12*a*) of the harness (12) at another point. In other words, the cutter (10) is configured to cut the harness (12) sequentially with the first edge portion (41*a*) and the second edge portion (41*b*) as the pusher (32) moves forward due to the high-pressure gas.

According to the third variation, the cutting portion (41) includes two different heights. Thus, the first edge portion (41*a*) cuts the harness (12), and the second edge portion (41*b*) cuts the harness (12) thereafter. In other words, the harness (12) can be cut at two different points sequentially at different times unlike a conventional cutter which cuts the harness (12) at two points at the same time to ensure a necessary width of a cut portion (the width of insulation). It is thus possible to cut the harness (12) with half the power as used in the conventional cutter, while ensuring the same cut portion (the width of insulation) as the conventional cutter. As a result, insulation capability of the cut portion can be ensured, while reducing an amount of the explosive necessary for cutting the harness (12).

Since the amount of the explosive can be reduced, the impact force applied to the cutter (10) at the gas generation can be reduced. It is thus possible to reduce the weight of the cutter (10) and simplify the structure thereof, and a large part of the case (11) can be made of a resin material. The other configurations, effects and advantages are the same as those in the first embodiment.

Fourth Variation of First Embodiment

Figure 12:
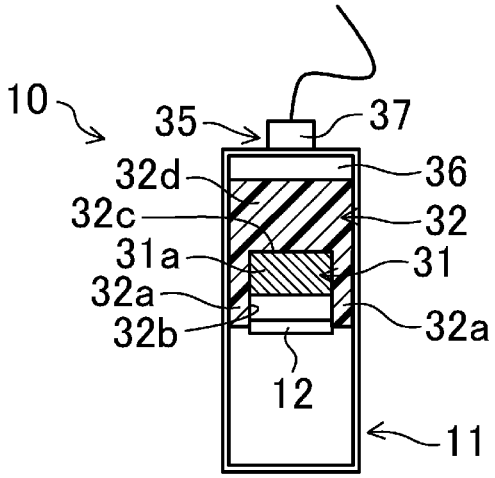
FIG. 12 is a schematic view of a cutter of the fourth variation of the first embodiment.

Now, the fourth variation of the first embodiment will be described. As shown in FIG. 12, a cutter (10) of the fourth variation has a cutting portion (31) of which the configuration is different from the configuration of the cutting portion (31) of the cutter (10) of the first embodiment. Specifically, in the cutter (10) of the fourth variation, the cutting portion (31) includes an edge portion (31*a*) made of a metal material and having a flat front end. The cutting portion (31) is fitted to the base end of the front end portion (32*c*) of the pusher (32) so as to be located between the pair of guide portions (32*a*, 32*a*). The edge portion (31*a*) may be made of a resin material. The other configurations, effects and advantages are the same as those in the first embodiment.

Second Embodiment of the Invention

Figure 13:
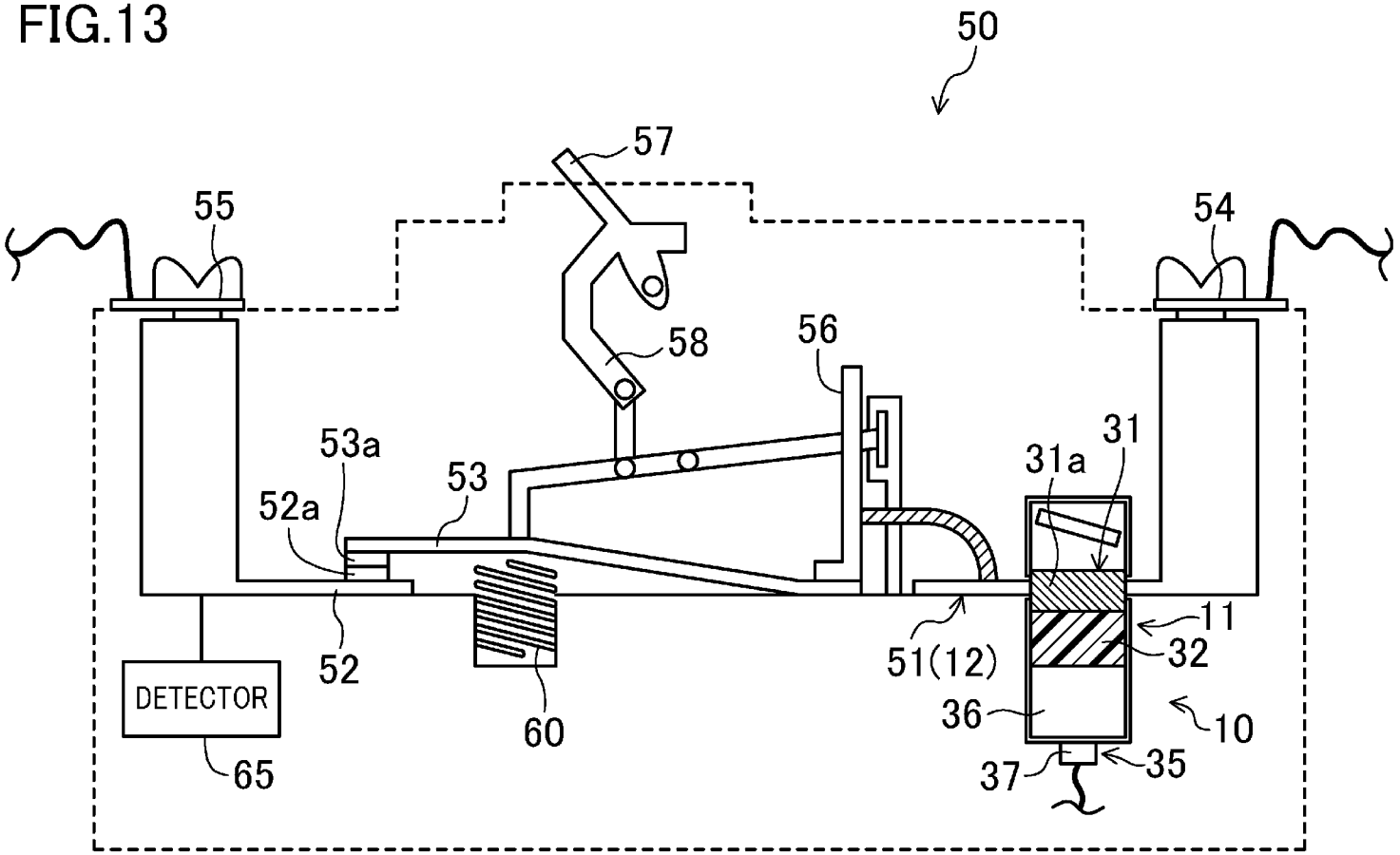
FIG. 13 is a schematic view of a breaker of the second embodiment.

Now, the second embodiment will be described. As shown in FIG. 13, the second embodiment is directed to a breaker (50) including a cutter (10) of the present invention. The breaker (50) includes a load terminal (55) and a line terminal (54) provided on the resin casing (not shown), and a terminal-to-terminal connection member (51) which is a harness (12) configured to connect the load terminal (55) and the line terminal (54).

The terminal-to-terminal connection member (51) includes a stationary contact (52) connected to the load terminal (55), and a movable contact (53) connected to the line terminal (54). The movable contact (53) is movable between the contact location at which the movable contact (53) is in contact with the stationary contact (52) and a noncontact location at which the movable contact (53) is apart from the stationary contact (52). When the movable contact (53) moves to the contact location, a movable contact point (53*a*) of the movable contact (53) is in contact with a stationary contact point (52*a*) of the stationary contact (52).

Further, the breaker (50) includes a linkage (58) configured to move the movable contact (53) manually, a trip mechanism (56) configured to separate the movable contact (53) from the stationary contact (52) in the event of abnormal current conditions, and a bias spring (60) configured to bias the movable contact (53) to separate the movable contact (53) from the stationary contact (52). The linkage (58) is attached to the casing such that the movable contact (53) can be moved between the contact location and the noncontact location by operation of a manual lever (57). The trip mechanism (56) is made of bimetal, and provides connection between the movable contact (53) and the line terminal (54). The trip mechanism (56) is thermally deformed in the event of overcurrent conditions (abnormal current conditions), and the thermal deformation allows the linkage (58) to move, thereby separating the movable contact (53) from the stationary contact (52). When the movable contact (53) is separated from the stationary contact (52), the breaker (50) cannot be energized.

Furthermore, the breaker (50) includes the above-described cutter (10), and a weld detector (65) configured to detect the welding between the movable contact point (53*a*) and the stationary contact point (52*a*). Any one of the cutters (10) of the first embodiment and other embodiments described later may be used as the cutter (10) of the present embodiment.

The cutter (10) is located so as to be able to cut the terminal-to-terminal connection member (51). Specifically, the cutter (10) is located on the back surface (i.e., the lower surface in FIG. 13) of the terminal-to-terminal connection member (51).

The weld detector (65) is connected to, e.g., the terminal-to-terminal connection member (51) to detect whether or not the movable contact point (53*a*) and the stationary contact point (52*a*) are welded together based on a current value of the terminal-to-terminal connection member (51). An igniter (37) of the cutter (10) is connected to the weld detector (65). When the weld detector (65) determines that the movable contact point (53*a*) and the stationary contact point (52*a*) are welded together, the weld detector (65) actuates the igniter (37).

In the second embodiment, when the weld detector (65) determines that the movable contact point (53*a*) and the stationary contact point (52*a*) are welded together, the igniter (37) is actuated to explode an explosive, and the blade (30) moves forward. The blade (30) cuts (i.e., breaks) the terminal-to-terminal connection member (51), and then the pusher (32) stops while being in contact with the cut surfaces of the terminal-to-terminal connection member (51). This allows insulation between the cut surfaces of the terminal-to-terminal connection member (51), thereby disabling the passage of current between the line terminal (54) and the load terminal (55).

Advantages of Second Embodiment

In the second embodiment, the cutter (10) can forcibly disable the passage of current between the line terminal (54) and the load terminal (55). Thus, for example, even when the movable contact (53) and the stationary contact (52) are welded together, the cutter (10) can forcibly disable the passage of current between the line terminal (54) and the load terminal (55) to prevent a breakdown of a load-side device. The other configurations, effects and advantages are the same as those in the first embodiment.

Third Embodiment of the Invention

Figure 14:
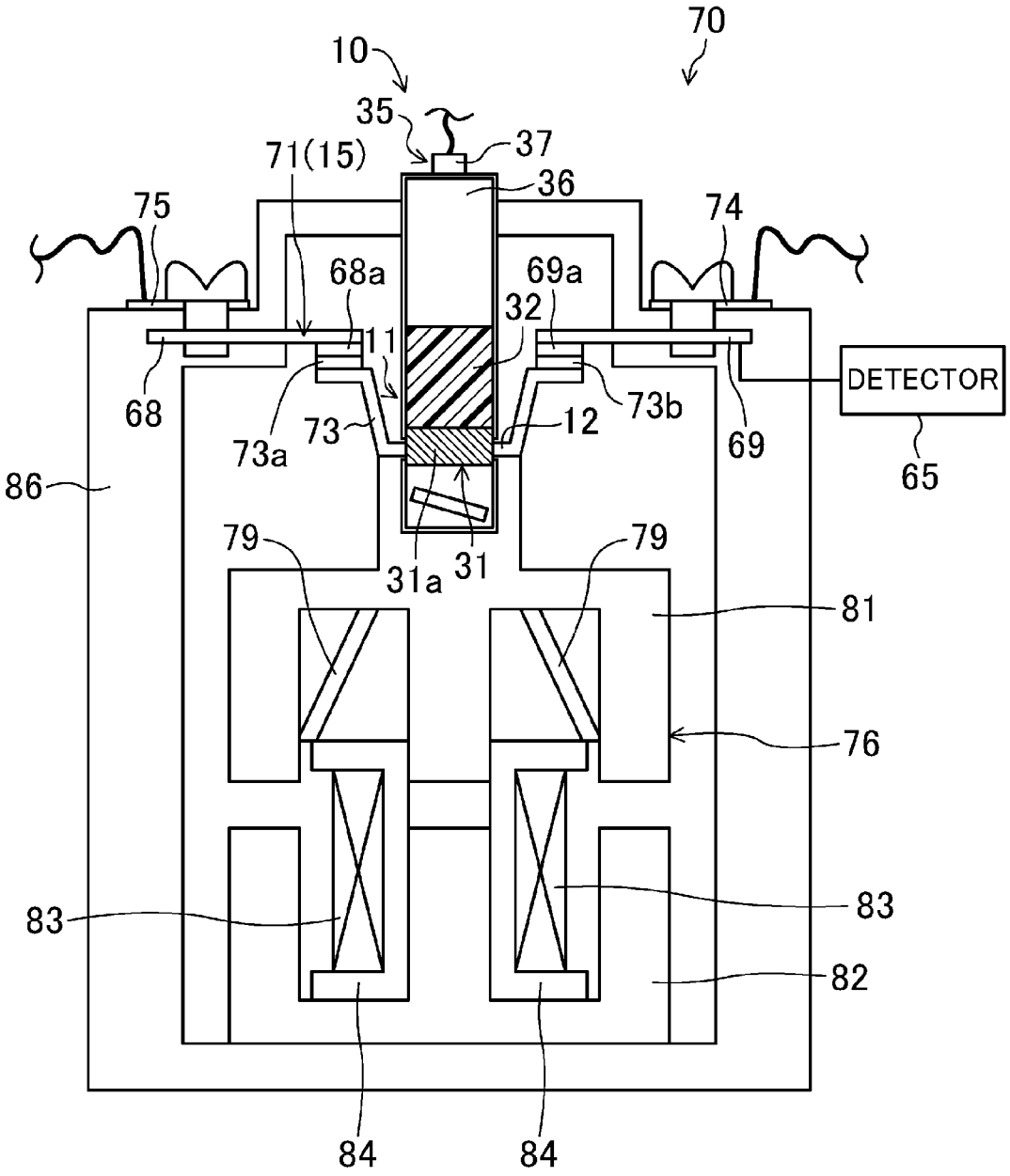
FIG. 14 is a schematic view of a contactor of the third embodiment.

Now, the third embodiment will be described. As shown in FIG. 14, the third embodiment is directed to a contactor including a cutter (10) according to the present invention. As shown in FIG. 14, the contactor (70) includes a load terminal (75) and a line terminal (74) provided on a resin casing (86), and a terminal-to-terminal connection member (71) which is a harness (12) configured to connect the load terminal (75) and the line terminal (74).

The terminal-to-terminal connection member (71) includes a first stationary contact (68) connected to the load terminal (75), a second stationary contact (69) connected to the line terminal (74), and a movable contact (73) coupled to a movable core (81) described below. The movable contact (73) is movable between the contact location at which the movable contact (73) is in contact with a pair of stationary contacts (68, 69) and a noncontact location at which the movable contact (73) is apart from the pair of stationary contacts (68, 69). When the movable contact (73) moves to the contact location, a movable contact point (73*a*) at one end of the movable contact (73) comes in contact with a first stationary contact point (68*a*) of the first stationary contact (68), and a movable contact point (73*b*) at the other end of the movable contact (73) comes in contact with a second stationary contact point (69*a*) of the second stationary contact (69).

Further, the contactor (70) includes a transfer mechanism (76) configured to transfer the movable contact (73) between the contact location and the noncontact location. The transfer mechanism (76) includes a movable core (81), a stationary core (82), an exciting coil (83), and a spool (84). The stationary core (82) is fixed to the bottom surface of the casing (86). The movable core (81) faces an upper surface of the stationary core (82). The exciting coil (83) is wound around the spool (84). A pair of return springs (79) are provided between the movable core (81) and the spool (84) to separate the movable core (81) from the stationary core (82) when the contactor (70) is in a non-energized condition.

The transfer mechanism (76) is configured such that when the exciting coil (83) is energized by an external signal, the stationary core (82) is excited to attract the movable core (81). When the movable core (81) is attracted by the stationary core (82), the contactor (70) is in a non-energized condition. By contrast, the transfer mechanism (76) is configured such that when the energization of the exciting coil (83) is stopped by an external signal, the return springs (79) separate the movable core (81) from the stationary core (82). The separation of the movable core (81) from the stationary core (82) allows the contactor (70) to be in an energized condition.

Furthermore, the contactor (70) includes the above-described cutter (10), and a weld detector (65) having a configuration similar to that of the second embodiment. Any one of the cutters (10) of the first embodiment and other embodiments described later may be used as the cutter (10) of the present embodiment.

The cutter (10) is located so as to be able to cut the terminal-to-terminal connection member (71). Specifically, the cutter (10) is disposed such that a cutting portion (31) of the blade (30) which has not yet moved forward faces a front surface of the movable contact (73).

In the third embodiment, when the weld detector (65) determines that the movable contact points (73*a*, 73*b*) are each welded to a corresponding one of the stationary contact points (68*a*, 69*a*), the igniter (37) is actuated to explode an explosive, and the blade (30) moves forward. The blade (30) cuts the movable contact (73). In this situation, the pusher (32) is in contact with the cut surfaces of the movable contact (73). In other words, the blade (30) moves forward until the pusher (32) comes in contact with the cut surfaces of the movable contact (73).

Advantages of Third Embodiment

In the third embodiment, the cutter (10) can forcibly disable the passage of current between the line terminal (74) and the load terminal (75). Thus, for example, even when the movable contact (73) and the stationary contacts (68, 69) are welded together, the cutter (10) can forcibly disable the passage of current between the line terminal (74) and the load terminal (75) to prevent a breakdown of a load-side device. The other configurations, effects and advantages are the same as those in the first embodiment.

Fourth Embodiment of Invention

Figure 15:
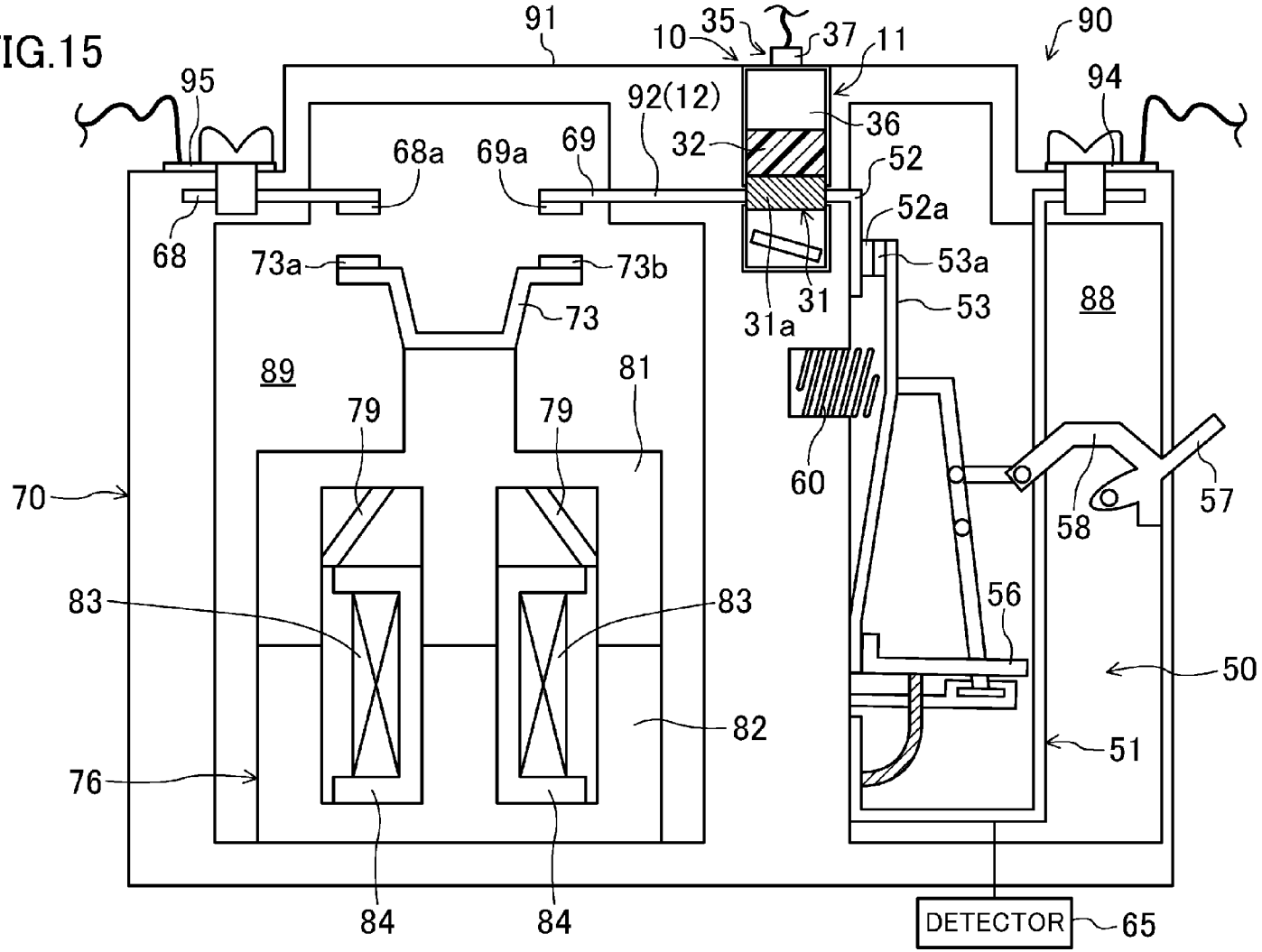
FIG. 15 is a schematic view of an electric circuit breaker of the fourth embodiment.

Now, the fourth embodiment will be described. As shown in FIG. 15, the fourth embodiment is directed to an electric circuit breaker (90) including a cutter (10) of the present invention. The electric circuit breaker (90) includes a breaker (50), a contactor (70), and a resin casing (91). Descriptions of the breaker (50) and the contactor (70) are not given.

A breaker placement chamber (88) in which the breaker (50) is placed, and a contactor placement chamber (89) in which the contactor (70) is placed are formed in the casing (91) with a barrier interposed therebetween. The casing (91)

includes a load terminal (95), a line terminal (94), and a connection member (92) providing connection between the breaker (50) and the contactor (70). The connection member (92) is a harness (12).

The load terminal (95) is connected to a first stationary contact (68) of the contactor (70). The line terminal (94) is connected to a movable contact (53) of the breaker (50). Further, one end of the connection member (92) is connected to a second stationary contact (69) of the contactor (70). The other end of the connection member (92) is connected to a stationary contact (52) of the breaker (50).

Moreover, the electric circuit breaker (90) includes the above-described cutter (10), and a weld detector (65) similar to that of the second embodiment. Any one of the cutters of the first embodiment and other embodiments described later may be used as the cutter (10) of the present embodiment.

The cutter (10) is located so as to be able to cut the connection member (92). Specifically, the cutter (10) is disposed such that a cutting portion (31) of a blade (30) which has not yet moved forward faces a front surface of the connection member (92).

In the fourth embodiment, when the weld detector (65) determines that in the breaker (50), the movable contact (53) and the stationary contact (52) are welded together, or when the weld detector (65) determines that in the contactor (70), the movable contact (73) and the stationary contacts (68, 69) are welded together, the weld detector (65) actuates the igniter (37), and the blade (30) moves forward to cut (i.e., break) the connection member (92). In this situation, the pusher (32) is in contact with the cut surfaces of the connection member (92). In other words, the blade (30) moves forward until the pusher (32) comes in contact with the cut surfaces of the connection member (92).

Advantages of Fourth Embodiment

In the fourth embodiment, the cutter (10) cuts the connection member (92), thereby disabling the passage of current between the line terminal (94) and the load terminal (95). Thus, for example, even when, in the breaker (50) or the contactor (70), contacts are welded together, the cutter (10) can disable the passage of current between the line terminal (94) and the load terminal (95) to prevent a breakdown of a load-side device. The other configurations, effects and advantages are the same as those in the first embodiment.

Other Embodiments

The first to fourth embodiments of the present invention may have the following configurations.

In the above embodiments, the stopper (23) is made of a metal material, but the material forming the stopper (23) is not limited to the metal material, and may be made of a resin material, such as plastic.

In the above embodiments, the first inner cylinder member (25) is made of ceramic. However, the material forming the first inner cylinder member (25) is not limited to ceramic, and may be a resin material, such as plastic.

In the above embodiments, the case (11) includes the resin case (20) and the metal case (27), but the entire case (11) may be made of resin.

The foregoing embodiments are merely preferred examples in nature, and are not intended to limit the scope of the present invention, applications, and use of the invention.

INDUSTRIAL APPLICABILITY

As described above, the present invention is useful as a cutter configured to cut a current-carrying member.

DESCRIPTION OF REFERENCE CHARACTERS

11 case
12 harness
20 resin case
22 placement hole
23 stopper
27 metal case
30 blade
31 cutting portion
31*a* edge portion
32*a* guide portions

The invention claimed is:

1. A cutter, comprising: a blade which has a cutting portion; and a case member which accommodates the blade such that the blade is movable in a forward and backward direction, the cutter being configured such that the blade is moved in a predetermined forward direction by increasing a pressure in the case member by a high-pressure gas generated by a reaction of a gas-generating agent, thereby cutting, with the cutting portion, a current-carrying member which is located forward of the blade and through which electricity flows, wherein the cutter includes a stopper member with which the blade after cutting the current-carrying member with the cutting portion collides and stops, and the blade includes a flexible guide member which is provided at the blade and protrudes further in the forward direction of the blade than the cutting portion.

2. The cutter of claim 1, wherein the blade is positioned such that before the blade is moved forward, a front end of the guide member is located forward of a back end of the current-carrying member in the forward direction of the blade.

3. The cutter of claim 1, wherein the cutting portion has an edge portion made of a resin material.

4. The cutter of claim 1, wherein the case member includes a first case member having a back pressure chamber in which the high-pressure gas is generated by the reaction of the gas-generating agent, and a second case member configured to accommodate the blade and provided with a placement hole located forward of the cutting portion of the blade that is not moved forward yet, for inserting the current-carrying member to be cut.

* * * * *